US009323265B2

(12) United States Patent
Bhattad et al.

(10) Patent No.: US 9,323,265 B2
(45) Date of Patent: Apr. 26, 2016

(54) VOLTAGE REGULATOR OUTPUT OVERVOLTAGE COMPENSATION

(71) Applicant: Dialog Semiconductor GmbH, Kirchheim/Teck-Nabern (DE)

(72) Inventors: Ambreesh Bhattad, Swindon (GB); Frank Kronmueller, Neudenau (DE); Pietro Gallina, Swindon (GB)

(73) Assignee: Dialog Semiconductor (UK) Limited, London (GB)

( * ) Notice: Subject to any disclaimer, the term of this patent is extended or adjusted under 35 U.S.C. 154(b) by 15 days.

(21) Appl. No.: 14/547,224

(22) Filed: Nov. 19, 2014

(65) Prior Publication Data

US 2015/0378379 A1 Dec. 31, 2015

(30) Foreign Application Priority Data

Jun. 27, 2014 (DE) ..... 10 2014 212 502

(51) Int. Cl.
*G05F 1/618* (2006.01)
*G05F 1/575* (2006.01)

(52) U.S. Cl.
CPC ..... *G05F 1/575* (2013.01)

(58) Field of Classification Search
CPC ..... G05F 1/56; G05F 1/563; G05F 1/59; G05F 1/595; G05F 1/613
USPC ..... 323/226, 268, 269, 270, 273, 275
See application file for complete search history.

(56) References Cited

U.S. PATENT DOCUMENTS 7,402,985 B2 * 7/2008 Zlatkovic ..... G05F 1/56 323/270
7,714,553 B2 * 5/2010 Lou ..... G05F 1/563 323/268
8,134,349 B2 * 3/2012 Shiga ..... G05F 1/56 323/268
8,754,628 B2 * 6/2014 Namai ..... G05F 1/56 323/275
2004/0150382 A1 8/2004 Takabayashi
2010/0148735 A1 6/2010 Napravnik

OTHER PUBLICATIONS

German Office Action, 10 2014 212 502.2, Mailed: Oct. 1, 2014, Dialog Semiconductor GmbH.
Translation German Office Action: 10 2014 212 502.2, Mailed: Oct. 1, 2014, Dialog Semiconductor GmbH.

* cited by examiner

*Primary Examiner* — Gary L Laxton
(74) *Attorney, Agent, or Firm* — Saile Ackerman LLC; Stephen B. Ackerman

(57) ABSTRACT

Multi-stage amplifiers which provide a constant output voltage subject to load transients are presented. The amplifier has a pass device to source a load current at an output voltage. The amplifier has a first driver circuit to control the pass device based on a reference voltage and based on a first feedback voltage. The amplifier has a sink transistor to sink a first current from the output node to a low potential. Furthermore, the amplifier comprises a bypass transistor configured to couple a sense voltage, to sink a second current from the output node to the low potential. There is a second driver circuit to control the sink transistor and the bypass transistor, based on the reference voltage and based on a second feedback voltage. A voltage divider derives the first feedback voltage, the second feedback voltage and the sense voltage from the output voltage.

28 Claims, 13 Drawing Sheets

VOLTAGE REGULATOR OUTPUT OVERVOLTAGE COMPENSATION

TECHNICAL FIELD

The present document relates to multi-stage amplifiers, such as linear regulators or linear voltage regulators (e.g. low-dropout regulators) configured to provide a constant output voltage subject to load transients. In particular, the present document relates to a method and a circuit for overvoltage compensation of such multi-stage amplifiers.

BACKGROUND

An example of multi-stage amplifiers are low-dropout (LDO) regulators which are linear voltage regulators which can operate with small input-output differential voltages. A typical LDO regulator 100 is illustrated in FIG. 1*a*. The LDO regulator 100 comprises an output amplification stage 103, e.g. a field-effect transistor (FET), at the output and a differential amplification stage or differential amplifier 101 (also referred to as an error amplifier) at the input. A first input (fb) 107 of the differential amplifier 101 receives a fraction of the output voltage $V_{out}$ determined by the voltage divider 104 comprising resistors R0 and R1. The second input (ref) to the differential amplifier 101 is a stable voltage reference $V_{ref}$ 108 (also referred to as the bandgap reference). If the output voltage $V_{out}$ changes relative to the reference voltage $V_{ref}$, the drive voltage to the output amplification stage, e.g. the power FET (field effect transistor), changes by a feedback mechanism called main feedback loop to maintain a constant output voltage $V_{out}$.

The LDO regulator 100 of FIG. 1*a* further comprises an additional intermediate amplification stage 102 configured to amplify the output voltage of the differential amplification stage 101. As such, an intermediate amplification stage 102 may be used to provide an additional gain within the amplification path. Furthermore, the intermediate amplification stage 102 may provide a phase inversion.

In addition, the LDO regulator 100 may comprise an output capacitance $C_{out}$ (also referred to as output capacitor or stabilization capacitor or bybass capacitor) 105 parallel to the load 106. The output capacitor 105 may be used to stabilize the output voltage $V_{out}$ subject to a change of the load 106, in particular subject to a change of the load current $I_{load}$. It should be noted that typically the output current $I_{out}$ at the output of the output amplification stage 103 corresponds to the load current $I_{load}$ through the load 106 of the regulator 100 (apart from typically minor currents through the voltage divider 104 and the output capacitor 105). Consequently, the terms output current $I_{out}$ and load current $I_{load}$ are used synonymously, if not specified otherwise.

Typically, it is desirable to provide a stable output voltage $V_{out}$, even subject to transients of the load 106. By way of example, the regulator 100 may be used to provide a stable output voltage $V_{out}$ to the processor of an electronic device (such as a smartphone). The load current $I_{load}$ may vary significantly between a sleep state and an active state of the processor, thereby varying the load 106 of the regulator 100. In order to ensure a reliable operation of the processor, the output voltage $V_{out}$ should remain stable, even in response to such load transients.

At the same time, the LDO regulator 100 should be able to react rapidly to load transients, i.e. the LDO regulator 100 should be able to rapidly provide the requested load current $I_{load}$, subject to a load transient. This means that the LDO regulator 100 should exhibit a high bandwidth.

The regulator 100 shown in FIG. 1*a* is an example of a multi-stage amplifier. Such multi-stage amplifiers 100, notably LDOs, are mainly unidirectional devices i.e. they can typically either source or sink current. Certain operating conditions may cause a substantial overshoot of the output voltage $V_{out}$ at the output node of a multi-stage amplifier 100, which could damage a load 106 that is powered by the multi-stage amplifier 100. Example operating conditions are: a sudden removal of the load 106; the recovery from a transient in the supply voltage of the multi-stage amplifier 100, which has pushed the multi-stage amplifier 100 into deep dropout; a current being sourced into the output node of the multi-stage amplifier 100 by external pull-ups; the recovery from a current limit condition; and/or high temperature leakage from a pass device of the multi-stage amplifier 100.

A possible approach to addressing the problem of overshoots of the output voltage of a multi-stage amplifier 100 is the use of an active pull down circuit which is configured to remove an extra charge from the output capacitor 105. The active pull down may be implemented as a comparator or as an amplifier.

When a comparator is used and the current which is sourced into the output node is lower than the sinking capability of the pull down circuit, a sawtooth oscillation is typically observed at the output node of multi-stage amplifier 100 (see FIG. 3*b*). Such oscillations of the output voltage are typically undesirable, because such oscillations may negatively impact the load 106. On the other hand, when an amplifier is used, the compensation of such an amplifier may be difficult, if the capacitance of the output capacitor 105 of the multi-stage amplifier 100 is reduced. Furthermore, as the amplifier is typically not used under normal operation conditions (i.e. within an undervoltage situation at the output node), the current which is consumed by the amplifier of the pull down circuit is a burden on the minimum quiescent current for the multi-stage amplifier 100.

SUMMARY

The present document is directed at providing circuitry which is configured to stabilize an active pull down circuit (also referred to as a current sinking circuit) of a multi-stage amplifier. In particular, the active pull down circuit is to be stabilized using an output capacitor 105 with a reduced capacitance, in order to reduce the cost and the size of the multi-stage amplifier. Furthermore, the consumed quiescent current of the multi-stage amplifier is to be reduced.

According to an aspect, a multi-stage amplifier, such as a linear regulator, is described. The multi-stage amplifier comprises a pass device (e.g. a power transistor) which is configured to source a load current at an output voltage to an output node of the multi-stage amplifier. The load current may be provided to a load of the multi-stage amplifier, if the load is coupled to the output node. The load current may be drawn from a high potential (e.g. from a supply voltage) of the multi-stage amplifier. For this purpose, a source of the pass device may be (directly) coupled to the high potential and a drain of the pass device may be (directly) coupled to the output node. The load current may correspond to the source-drain current through the pass device.

The multi-stage amplifier further comprises a first driver circuit which is configured to control the pass device based on a reference voltage and based on a first feedback voltage, wherein the first feedback voltage is derived from the output voltage (e.g. is proportional to the output voltage). The reference voltage may be used to set the desired level of the output voltage. The first driver circuit may be configured to generate a first gate voltage for a gate of the pass device, based on the reference voltage and based on the first feedback voltage. In particular, the first gate voltage may be derived based on a difference of the reference voltage and the first feedback voltage. The first gate voltage may be (directly) applied to the gate of the pass device.

The multi-stage amplifier typically comprises a plurality of amplification stages. The pass device may be part of an output stage of the multi-stage amplifier. Furthermore, the first driver circuit may comprise one or more amplification stages. In particular, the first driver circuit may comprise a differential amplification stage which is configured to derive an intermediate voltage based on a difference between the reference voltage and the first feedback voltage. The first gate voltage may be derived based on the intermediate voltage. Furthermore, the first driver circuit may comprise an intermediate amplification stage configured to derive the first gate voltage for controlling the pass device, based on the intermediate voltage. Hence, the first gate voltage may be proportional to the difference between the reference voltage and the first feedback voltage.

As such, the multi-stage amplifier comprises a first driver circuit and a pass device for providing the load current at the output node at a regulated output voltage. The first driver circuit and the pass device may be configured to provide a stable output voltage, even subject to load transients (notable subject to an increase of the load current, i.e. subject to a positive load transient, which typically leads to an undervoltage situation at the output node of the multi-stage amplifier).

Furthermore, the multi-stage amplifier comprises current sinking circuitry (also referred to as a pull down circuit) which may be used in case of an overvoltage situation at the output node of the multi-stage amplifier (when the output voltage exceeds a pre-determined desired level). The current sinking circuitry allows the multi-stage amplifier to react to a reduction of the load in a rapid and stable manner.

The multi-stage amplifier (notably the current sinking circuitry) comprises a sink transistor which is arranged in series with the pass device and which is configured to sink a first current from the output node to a low potential (e.g. to ground) of the multi-stage amplifier. The output node may correspond to a midpoint between the pass device and the sink transistor. For sinking the first current, a drain of the sink transistor may be (directly) coupled to the output node and a source of the sink transistor may be (directly) coupled to the low potential. As such, the first current may correspond to the drain-source current through the sink transistor.

In addition, the multi-stage amplifier (notably the current sinking circuitry) comprises a bypass transistor which is configured to couple a sense voltage which is derived from the output voltage to the low potential, in order to sink a second current from the output node to the low potential. For sinking the second current, a drain of the bypass transistor may be coupled to the output node via an intermediate resistor (e.g. via a so called ESR (Equivalent Serial Resistance) resistor, and a source of the bypass transistor may be (directly) coupled to the low potential. As such, the second current may correspond to the drain-source current through the bypass transistor. The sense voltage may be derived from the output voltage such that the sense voltage is proportional to the output voltage.

Furthermore, the multi-stage amplifier (notably the current sinking circuitry) comprises a second driver circuit which is configured to control the sink transistor and the bypass transistor, based on the reference voltage and based on a second feedback voltage, wherein the second feedback voltage is derived from the output voltage. In particular, the second driver circuit may be configured to generate a second gate voltage for a gate of the sink transistor and for a gate of the bypass transistor, based on the reference voltage and based on the second feedback voltage (notably based on a difference between the reference voltage and the second feedback voltage). For this purpose, the second driver circuit may comprise a differential amplifier which is configured to derive the second gate voltage for application to the gate of the bypass transistor and for application to the gate of the sink transistor based on the difference between the reference voltage and the second feedback voltage. The second gate voltage may be proportional to the difference between the reference voltage and the second feedback voltage.

In addition, the multi-stage amplifier comprises a voltage divider which is arranged between the output node and the low potential and which is configured to derive the first feedback voltage, the second feedback voltage and the sense voltage from the output voltage, such that the sense voltage is higher than the first feedback voltage and such that the first feedback voltage is higher than the second feedback voltage. Typically, the sense voltage, the first feedback voltage and the second feedback voltage are smaller than the output voltage. Furthermore, the sense voltage, the first feedback voltage and the second feedback voltage are usually proportional to the output voltage By deriving the second feedback voltage such that it is lower than the first feedback voltage, it may be ensured that the sink transistor and the bypass transistor are only activated (in order to sink current from the output node), when the pass device is deactivated (i.e. when the pass device does not source any current). In particular, a dead band between the sourcing of current and the sinking of current at the output node may be provided. As a result of this, the operation of the multi-stage amplifier is stabilized.

Furthermore, by deriving the sense voltage such that it is greater than the first and second feedback voltage (and smaller than the output voltage), it is ensured that the drain-source voltage across the bypass transistor is smaller than the drain-source voltage across the sink transistor. As a result of this, the operating points of the bypass transistor and the sink transistor are (slightly) offset with respect to one another, thereby stabilizing the current sinking circuitry.

Overall, the above mentioned measures allow for the provision of a stable multi-stage amplifier which is configured to provide a stable output voltage, subject to positive load transients (for increasing load currents) and subject to negative load transients (for decreasing load current). Furthermore, the multi-stage amplifier exhibits a relatively low quiescent current, i.e. the multi-stage amplifier allows for a power efficient operation.

The voltage divider may comprise an internal ESR resistor which is configured to derive the sense voltage from the output voltage. By using an ESR resistor, it may be ensured that the sense voltage is (slightly) lower than the output voltage. Furthermore, the voltage divider may comprise a high resistor which is coupled to the output node via the ESR resistor and which is configured to derive the first feedback voltage from the output voltage. In addition, the voltage divider may comprise a dead band resistor which is coupled to the output node via the high resistor and which is configured to derive the second feedback voltage from the output voltage. In addition, the voltage divider may comprise a low resistor which, on a first side, is coupled to the output node via the dead band resistor, and which, on a second side, is (directly) coupled to the low potential. Hence, the voltage divider may comprise a serial arrangement comprising the ESR resistor which, on one side, is (directly) coupled to the output node and which, on the other side, is (directly) coupled to the high resistor, wherein the high resistor is (directly) coupled to the dead band resistor, wherein the dead band resistor is (directly) coupled to the low resistor, and wherein the low resistor is (directly) coupled to the low potential.

A resistance of the high resistor may be greater than a resistance of the internal ESR resistor by at least 1, 2, or 3 orders of magnitude. As such, the sense voltage may be only slightly lower than the output voltage, and the drain-source voltage across the bypass transistor may be only slightly lower than the drain-source voltage across the sink transistor, which may be beneficial regarding the stability of the output voltage during an overvoltage situation.

Furthermore, a size of the sink transistor may be greater than a size of the bypass transistor by at least 1, 2, or 3 orders of magnitude. As a result of this, the second current may be substantially smaller than the first current. This may be beneficial regarding the stability of the output voltage during an overvoltage situation.

The source of the bypass transistor may be coupled to the low potential via a first current limiting resistor and/or the drain of the bypass transistor may be coupled to the sense voltage via a second current limiting resistor. Such current limiting resistors may be used to set the operating point of the bypass transistor. In particular, the bypass transistor may be set within a linear region of the bypass transistor. By tuning the operating point of the bypass transistor relative to the operating point of the sink transistor, the stability of the current sinking circuit may be improved.

The multi-stage amplifier may further comprise a second bypass transistor which is arranged in parallel to the bypass transistor. The second driver circuit may be configured to also control the second bypass transistor. In particular, the second gate voltage may also be applied to a gate of the second bypass transistor. In a similar manner to the bypass transistor, a source of the second bypass transistor may be coupled to the low potential via a third current limiting resistor and/or a drain of the second bypass transistor may be coupled to the sense voltage via a fourth current limiting resistor. The third and/or forth current limiting resistor may be used to set the operating point of the second bypass transistor differently from the operating point of the bypass transistor. By using a plurality of bypass transistors and by tuning the resistor values in order to set different operating points for the plurality of bypass transistors, the stability of the current sinking circuit may be improved.

The multi-stage amplifier may further comprise an output capacitor which is arranged between the output node and the low potential. The output capacitor may create a zero within the transfer function of the multi-stage amplifier in conjunction with the bypass transistor (and the internal ESR resistor). This zero may be beneficial for the stability of the multi-stage amplifier.

The pass device may comprise or may be a P-type metaloxide semiconductor (MOS) transistor. The sink transistor may comprise or may be an N-type MOS transistor, and the bypass transistor may comprise or may be an N-type MOS transistor. Overall, the multi-stage amplifier may be implemented as an integrated circuit (IC), wherein typically only the output capacitor is implemented as an external component.

According to a further aspect, a method for reducing an overvoltage situation at an output node of a multi-stage amplifier is described. The method comprises sourcing a load current at an output voltage to the output node using a pass device. The load current may be drawn from a high potential of the multi-stage amplifier. The method further comprises controlling the pass device based on a reference voltage and based on a first feedback voltage derived from the output voltage. In addition, the method comprises sinking a first current from the output node to a low potential of the multi-stage amplifier using a sink transistor arranged in series with the pass device. The output node may correspond to a midpoint between the pass device and the sink transistor. Furthermore, the method comprises sinking a second current from the output node to the low potential using a bypass transistor which is configured to couple a sense voltage which is derived from the output voltage to the low potential. The method also comprises controlling the sink transistor and the bypass transistor, based on the reference voltage and based on a second feedback voltage derived from the output voltage. In addition, the method comprises deriving the first feedback voltage, the second feedback voltage and the sense voltage from the output voltage, such that the sense voltage is higher than the first feedback voltage and such that the first feedback voltage is higher than the second feedback voltage (and typically such that the sense voltage is lower than the output voltage).

It should be noted that the methods and systems including its preferred embodiments as outlined in the present document may be used stand-alone or in combination with the other methods and systems disclosed in this document. In addition, the features outlined in the context of a system are also applicable to a corresponding method. Furthermore, all aspects of the methods and systems outlined in the present document may be arbitrarily combined. In particular, the features of the claims may be combined with one another in an arbitrary manner.

In the present document, the term "couple" or "coupled" refers to elements being in electrical communication with each other, whether directly connected e.g., via wires, or in some other manner.

BRIEF DESCRIPTION OF THE DRAWINGS

The invention is explained below in an exemplary manner with reference to the accompanying drawings, wherein.

DESCRIPTION

Figure 1A:
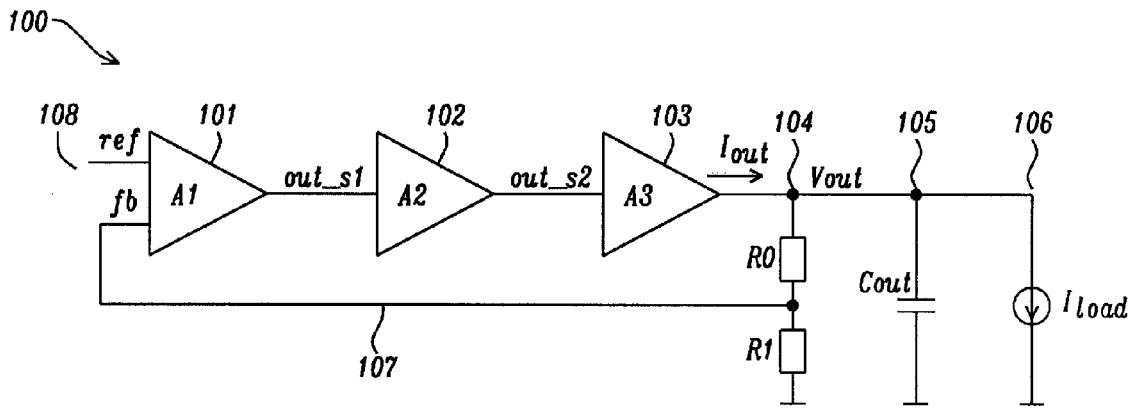
FIG. 1*a* illustrates an example block diagram of an LDO regulator.
Figure 1B:
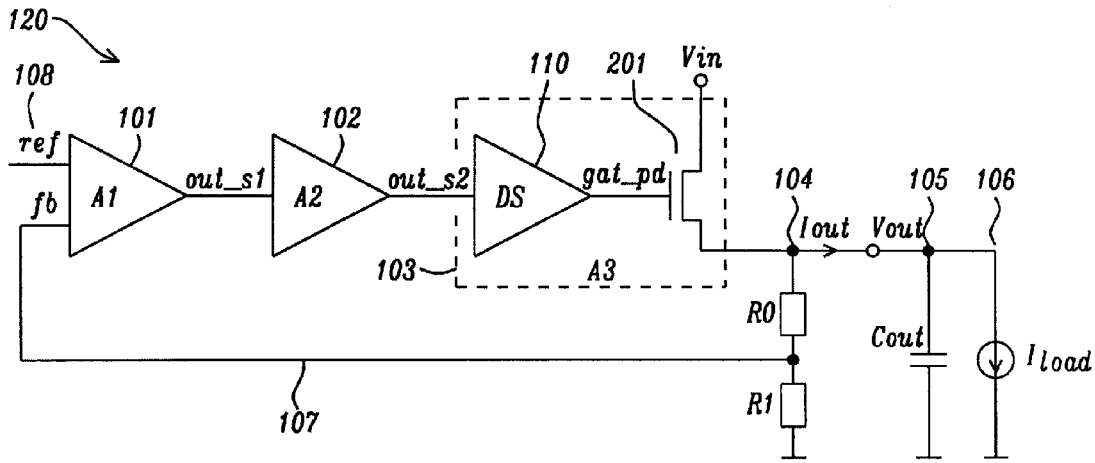
FIG. 1*b* illustrates the example block diagram of an LDO regulator in more detail.

As already outlined above, FIG. 1*a* shows an example block diagram for an LDO regulator 100 with its three amplification stages A1, A2, A3 (reference numerals 101, 102, 103, respectively). FIG. 1*b* illustrates the block diagram of a LDO regulator 120, wherein the output amplification stage A3 (reference numeral 103) is depicted in more detail. In particular, the pass transistor 201 and the driver stage 110 of the output amplification stage 103 are shown. Typical parameters of an LDO regulator are a supply voltage of 3V, an output voltage of 2V, and an output current or load current ranging from 1 mA to 100 or 200 mA. Other configurations are possible. The present invention is described in the context of a linear regulator. It should be noted, however, that the present invention is applicable to multi-state amplifiers in general.

It is desirable to provide a multi-stage amplifier such as the regulator 100, 120, which is configured to generate a stable output voltage $V_{out}$ subject to load transients. The output capacitor 105 may be used to stabilize the output voltage $V_{out}$, because in case of a load transient, an additional load current $I_{load}$ may be provided by the output capacitor 105. Furthermore, schemes such as Miller compensation and/or load current dependent compensation may be used to stabilize the output voltage $V_{out}$.

At the same time, it is desirable to provide a multi-stage amplifier with a high bandwidth. The above stabilization schemes may lead to a reduction of the speed of the multi-stage amplifier. As such, it is desirable to provide a stabilization scheme which has reduced impact on the bandwidth of the multi-stage amplifier.

Figure 2:
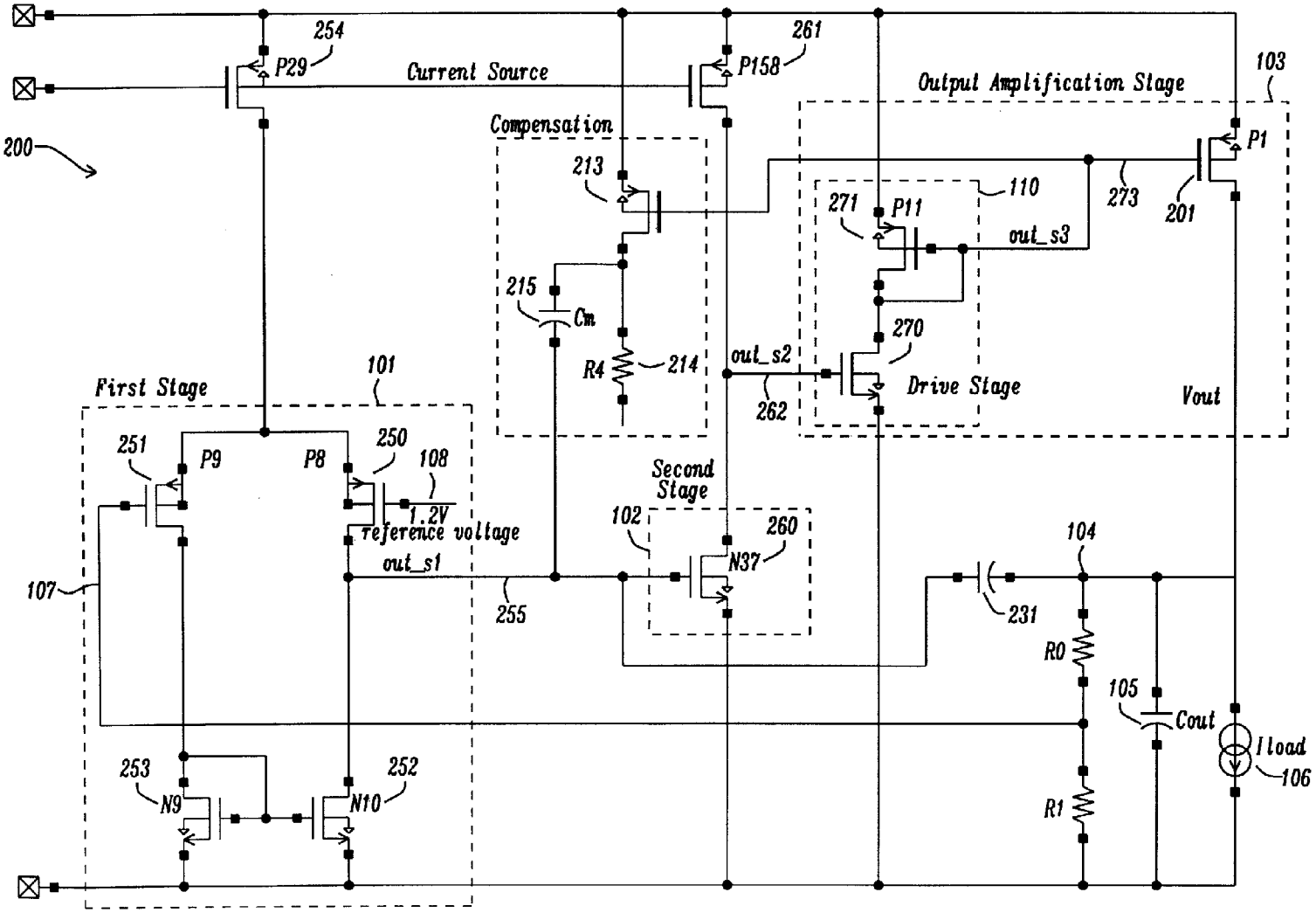
FIG. 2 shows an example circuit arrangement of an LDO regulator.

FIG. 2 illustrates an example circuit arrangement of an LDO regulator 200 comprising a Miller compensation using a capacitance $C_V$ 231 and a load current dependent compensation comprising a current mirror with transistors 201 (corresponding to the pass transistor 201) and 213, a compensation resistor 214 and a compensation capacitance $C_m$ 215.

The circuit implementation of FIG. 2 can be mapped to the block diagrams in FIGS. 1*a* and 1*b*, as similar components have received the same reference numerals. In the circuit arrangement 200, the differential amplification stage 101, the intermediate amplification stage 102 and the output amplification stage 103 are implemented using field effect transistors (FET), e.g. metal oxide semiconductor FETs (MOSFETs).

The differential amplification stage 101 comprises the differential input pair of transistors P9 251 and P8 250, and the current mirror N9 253 and N10 252. The input of the differential pair is e.g. a 1.2V reference voltage 108 at P8 and the feedback 107 at P9 which is derived from the resistive divider 104 (with e.g. R0=0.8 MΩ and R1=1.2 MΩ).

The intermediate amplification stage 102 comprises a transistor N37 260, wherein the gate of transistor N37 260 is coupled to the stage output node 255 of the differential amplification stage 101. The transistor P158 261 acts as a current source for the intermediate amplification stage 102, similar to transistor P29 254 which acts as a current source for the differential amplification stage 101.

The output amplification stage 103 is coupled to the stage output node 262 of the intermediate amplification stage 102 and comprises a pass device or pass transistor 201 and a gate driver stage 110 for the pass device 201, wherein the gate driver stage comprises a transistor 270 and a transistor P11 271 connected as a diode. This gate driver stage has essentially no gain since it is low-ohmic through the transistor diode P11 271 which yields a resistance of $1/g_m$ (output resistance of the driver stage 110 of the output amplification stage 103) to signal ground. The gate of the pass transistor 201 is identified in FIG. 2 with reference numeral 273.

In the present document, means for stabilizing the output voltage of a multi-stage amplifier such as the regulator 200 are described. These means may be used in conjunction with other stabilizing means, such as an output capacitor 105, Miller compensation 231 and/or load current dependent compensation 213, 214, 215. The described stabilizing means are configured to increase the stability of the multi-stage amplifier 200 subject to load transients, and at the same time to allow for a fast convergence of the multi-stage amplifier 200 subject to such load transients. In particular, the means which are described in the present document allow stabilizing the output voltage of the multi-stage amplifier 200 in case of an overvoltage situation.

Figure 3A:
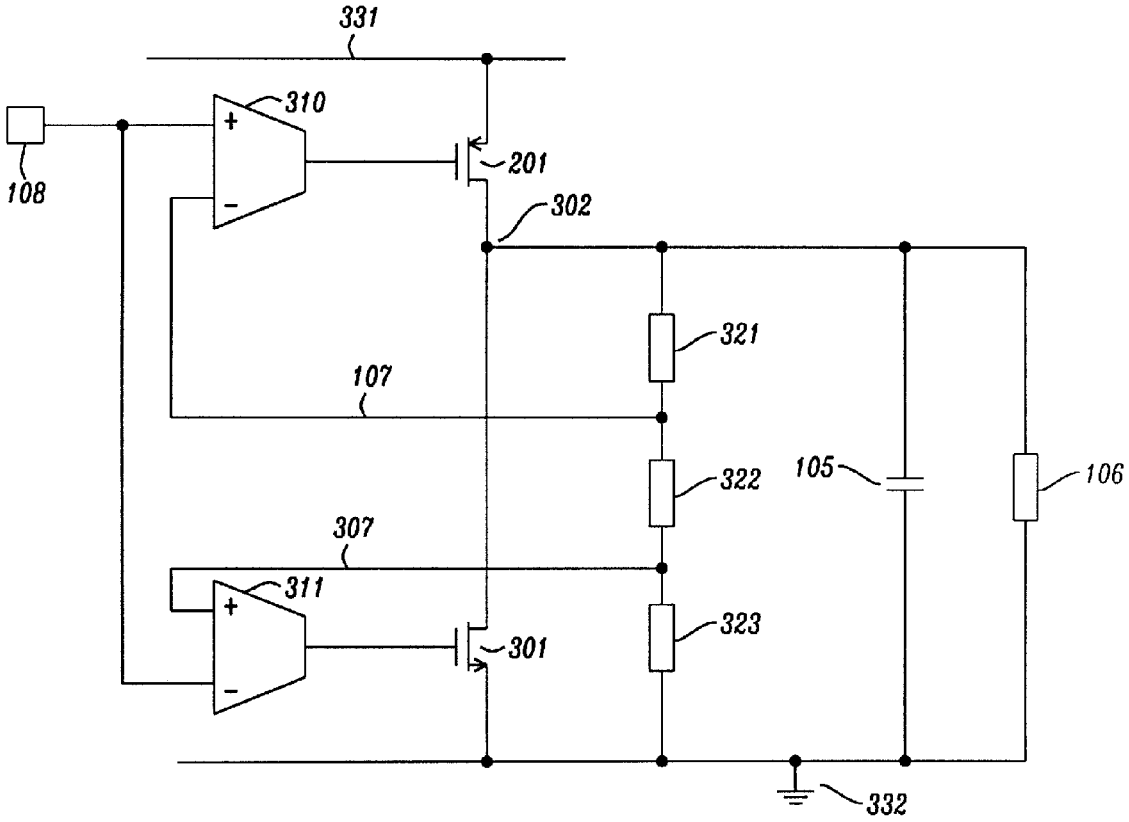
FIG. 3*a* shows a block diagram of an example multi-stage amplifier comprising an active pull down circuit.

FIG. 3*a* is an example schematic for an implementation of a current sink or over-voltage sink (also referred as current sinking circuitry or pull down circuit). In particular, FIG. 3*a* shows a pull down circuit which may be used to sink current in case of an overvoltage situation. In FIG. 3*a* the different amplification stages of the multi-stage amplifier 200 are represented by a first driver circuit 310 which drives the pass device 201. In particular, the output of the first driver circuit 310 is controlling the gate of the pass device 201. The resistors 321, 322, 323 form the voltage divider 104 for generating the feedback voltage 107, which is used to regulate the output voltage of the multi-stage amplifier 200 using the first driver circuit 310. The capacitor 105 is an external decoupling capacitor, and the load 106 may be an external integrated circuit (IC) which is powered by the multi-stage amplifier 200 (e.g. by an LDO).

A second driver circuit 311 and a sink transistor 301 may be used to sink current from the output node 302 of the multi-stage amplifier 200, in case of an overvoltage situation. Under normal operation (i.e. if the feedback voltage 107 corresponds to or falls below the reference voltage Vref 108), the second feedback voltage 307 is lower than the reference voltage 108 (due to the dead band resistor 322). As a result of this, the gate of the sink transistor 301 is pulled to ground 332, thereby closing the sink transistor 301. Hence, under normal operation (i.e. within an undervoltage situation), no current is sunk from the output node 302 of the multi-stage amplifier 200.

In an overvoltage condition, if the second feedback voltage 307 is higher than or equal to the reference voltage Vref 108, the gate of the sink transistor 301 is pulled high, thereby opening the sink transistor 301 and thereby activating the current sink. The gate of the sink transistor 301 is driven by the second driver circuit 311 to sink the current from the output node 302 of the multi-stage amplifier 200. The dead band resistor 322 defines the level of the output voltage at which the current sink (i.e. the sink transistor 301) is activated. As such, the dead band resistor 322 defines a dead band between the deactivation of the sourcing of current (via the pass device 201) and the activation of the current sink (via the sink transistor 301).

Figure 3B:
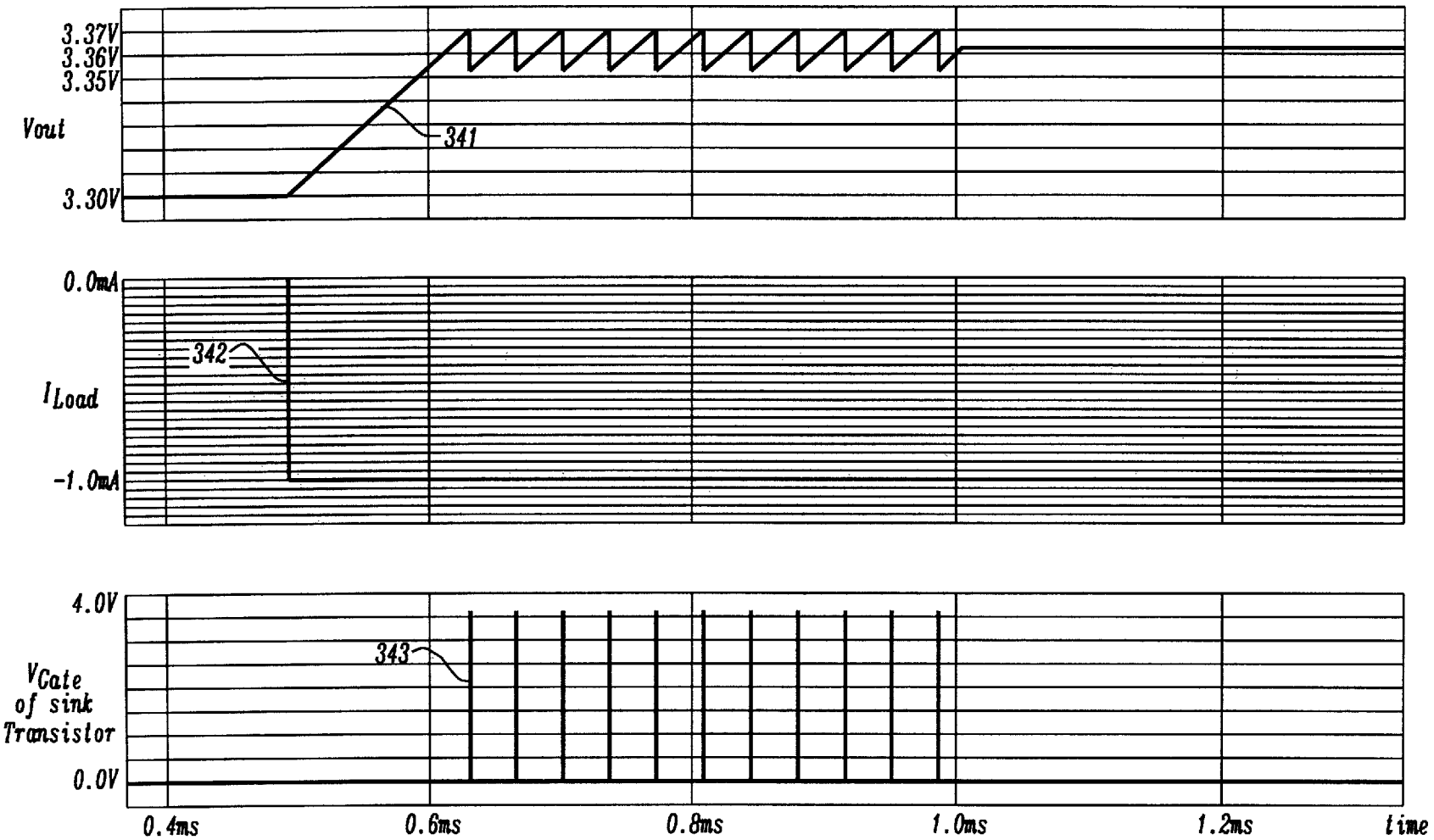
FIGS. 3*b* to 3*e* show example measurements.
Figure 3C:
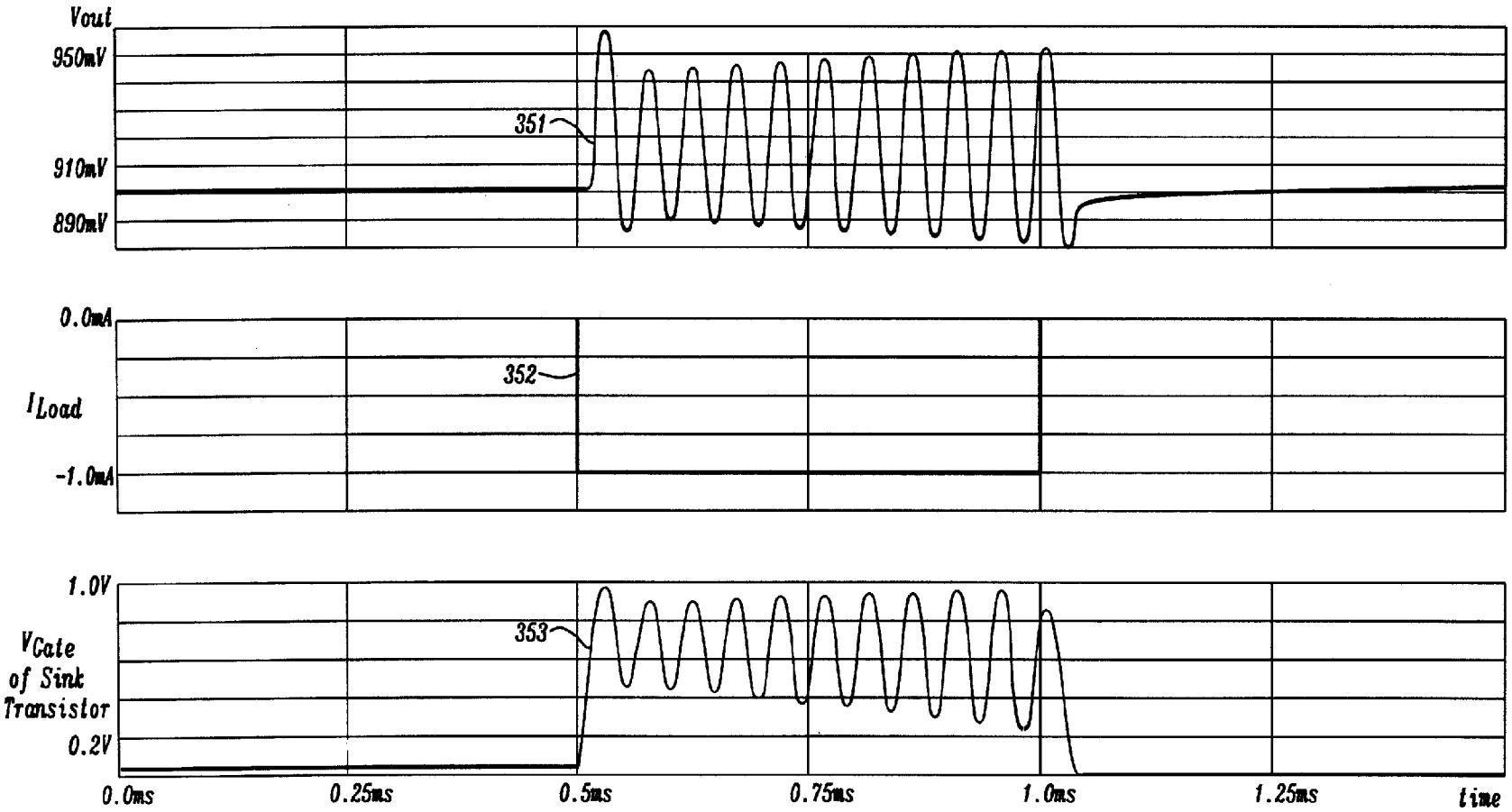

If the second driver circuit 311 is configured as a comparator, the gate of the sink transistor 301 is driven either to the supply voltage 331 or to ground 332. If the second driver circuit 311 along with the sink transistor 301 and the output capacitor 105 is configured as an amplifier, the gate of the sink transistor 301 is regulated depending on the difference between the second feedback voltage 307 and the reference voltage Vref 108. This is illustrated in FIGS. 3*b* and 3*c*. FIG. 3*b* shows the case where the second driver circuit 311 of the sink transistor 301 is operated as a comparator. In particular, FIG. 3*b* shows the output voltage graph 341 as a function of time, subject to a reduction of the load 106 at the output of the multi-stage amplifier 200. The reduction of the load 106 is illustrated by a reduction of the load current graph 342 (e.g. by 1 mA), at the time instant when the output voltage 341 starts to rise (e.g. from 3.3V up to 3.37V). It can be seen that the current sinking circuitry 311, 301 is activated and deactivated in a periodic manner. In particular, the gate voltage graph 343 at the gate of the sink transistor 301 swings between ground (e.g. 0V) and the supply voltage (e.g. 3.5V). This is due to the fact that as a result of an increased output voltage 341, the sink transistor 301 is opened to sink current, thereby reducing the output voltage 341. If the output voltage 341 falls below a pre-determined threshold, the sink transistor 301 is closed, thereby deactivating the sink capability. As a result of this, the output voltage 341 increases again, and so on.

FIG. 3*c* shows the case where the second driver circuit 311 of the sink transistor 301 is operated as an amplifier. Again the output voltage graph 351, the relative load current graph 352 and the gate voltage graph 353 at the gate of the sink transistor 301 are shown as a function of time. Again 1 mA of current is sourced into the output node 302 of the multi-stage amplifier 200, thereby creating an overvoltage situation. An oscillation with an amplitude of 70 mV is observed at the output node 302 of the multi-stage amplifier 200.

The oscillations of the output voltage graph of FIG. 3*b* 341 and of the graph of FIG. 3*c* 351, which are caused by the current sinking circuitry 311, 301, are typically undesirable, notably if the multi-stage amplifier 200 powers a sensitive analog chip.

Figure 3D:
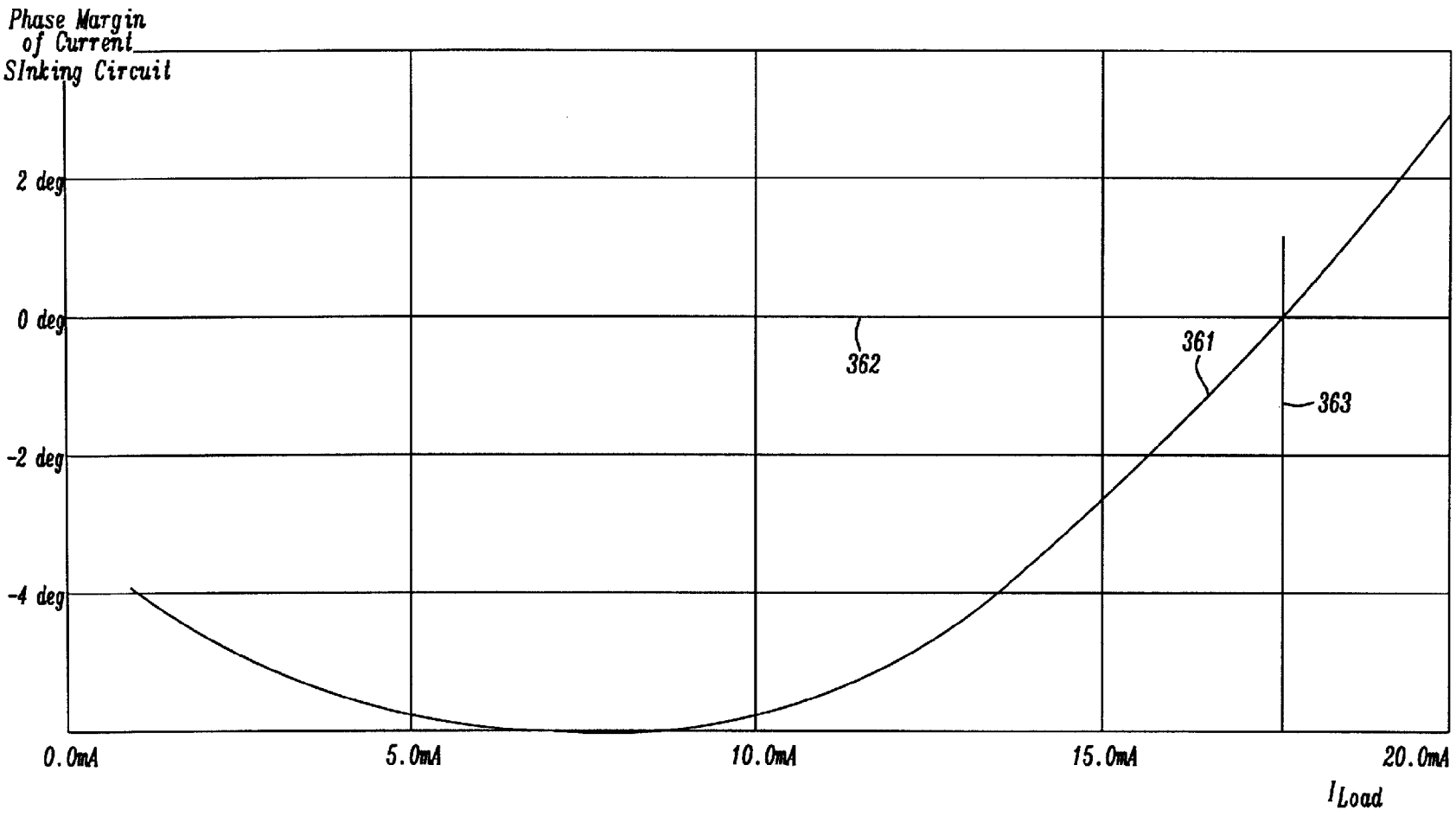

FIG. 3*d* shows the phase margin graph 361 for the current sinking circuitry 311, 301 as a function of the load current which has to be sunk by the sink transistor 301. The graph has been prepared for an output capacitor 105 (FIG. 3*a*) of 0.47 μF under typical operating conditions. As can be seen in FIG. 3*d*, the phase margin graph 361 is below zero (indicated by the horizontal line 362) up to a certain level of load current (indicated by the vertical line 363 and corresponding e.g. to 17 mA). As such, the current sinking circuitry 311, 301 is stable (ie. the phase margin is above zero) only for load currents 361 which are above the load current indicated by the vertical line 363 (e.g. 17 mA). The phase margin 361 typically improves as the capacitance of the output capacitor 105 of FIG. 3*a* is increased. On the other hand; the phase margin 361 typically decreases as the capacitance of the output capacitor 105 decreases.

The current sinking circuitry 311, 301 has two dominant poles one at the gate of the sink transistor 301 and another one at the drain of the sink transistor 301 (i.e. at the output node 302 of the multi-stage amplifier 200). The provision of a Miller compensation is typically difficult to achieve, as the output capacitor 105 may vary from 0.47 μF to higher values. As the output capacitor 105 it typically implemented off-chip, i.e. not as an integrated component of an IC forming the multi-stage amplifier 200, the capacitance of the output capacitor 105 may suffer from variation due to temperature, DC bias, tolerances etc. This renders the provision of a reliable Miller compensation difficult. Furthermore, it is typically not possible to implement a substantial current within the current sinking circuitry 311, 301 as this would add to quiescent current consumption of the multi-stage amplifier 200. Hence, other means for stabilizing the operation of the current sinking circuitry 311, 301 are desirable.

Figure 4:
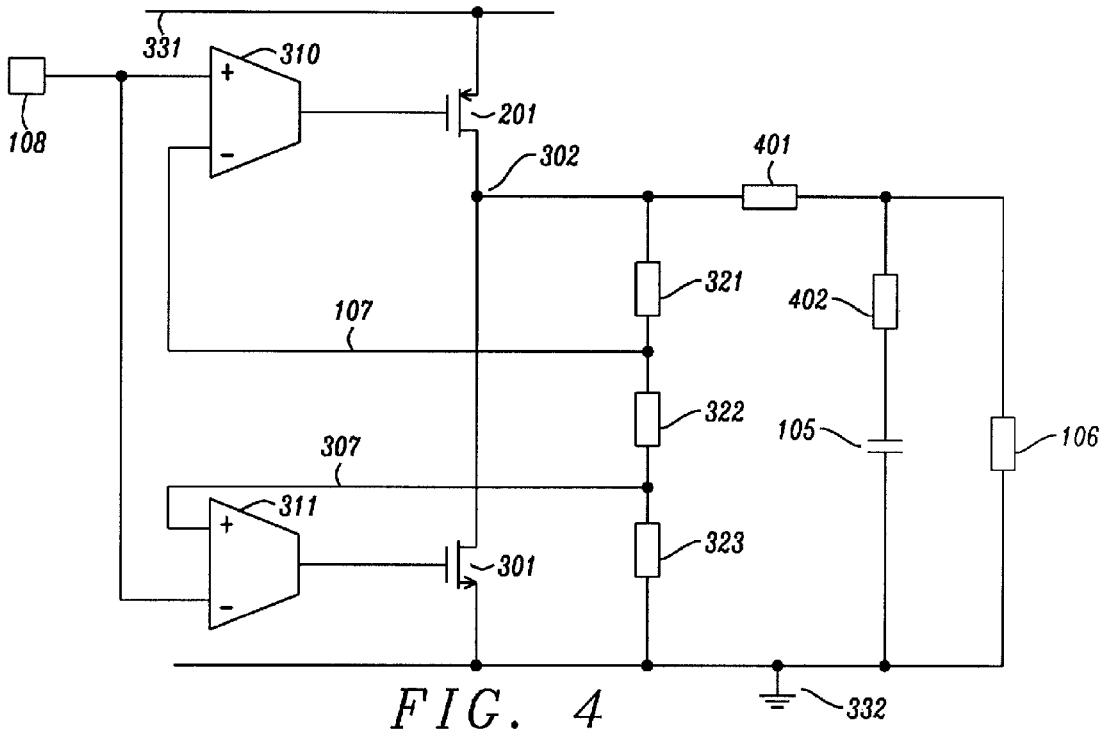
FIG. 4 shows a block diagram of an example multi-state amplifier comprising a stabilized pull down circuit.

A possible approach to stabilizing the current sinking circuitry 311, 301 is to provide an ESR (Equivalent Series Resistance) resistor 402 in series with the output capacitor 105, as shown in FIG. 4. The ESR resistor 402 adds an LHP (left half plane) zero to the current sinking circuitry 311, 301 and boosts the phase margin of the current sinking circuitry 311, 301, thereby making the current sinking circuitry 311, 301 stable. The LHP zero is a function of the resistance of the ESR resistor 402 and of the capacitance of the output capacitor 105. It should be noted that the capacitor 105 typically comprises an inherent ESR and also the PCB (printed circuit board) comprises an inherent ESR (represented by the resistor 401), which typically cannot be controlled.

Figure 3E:
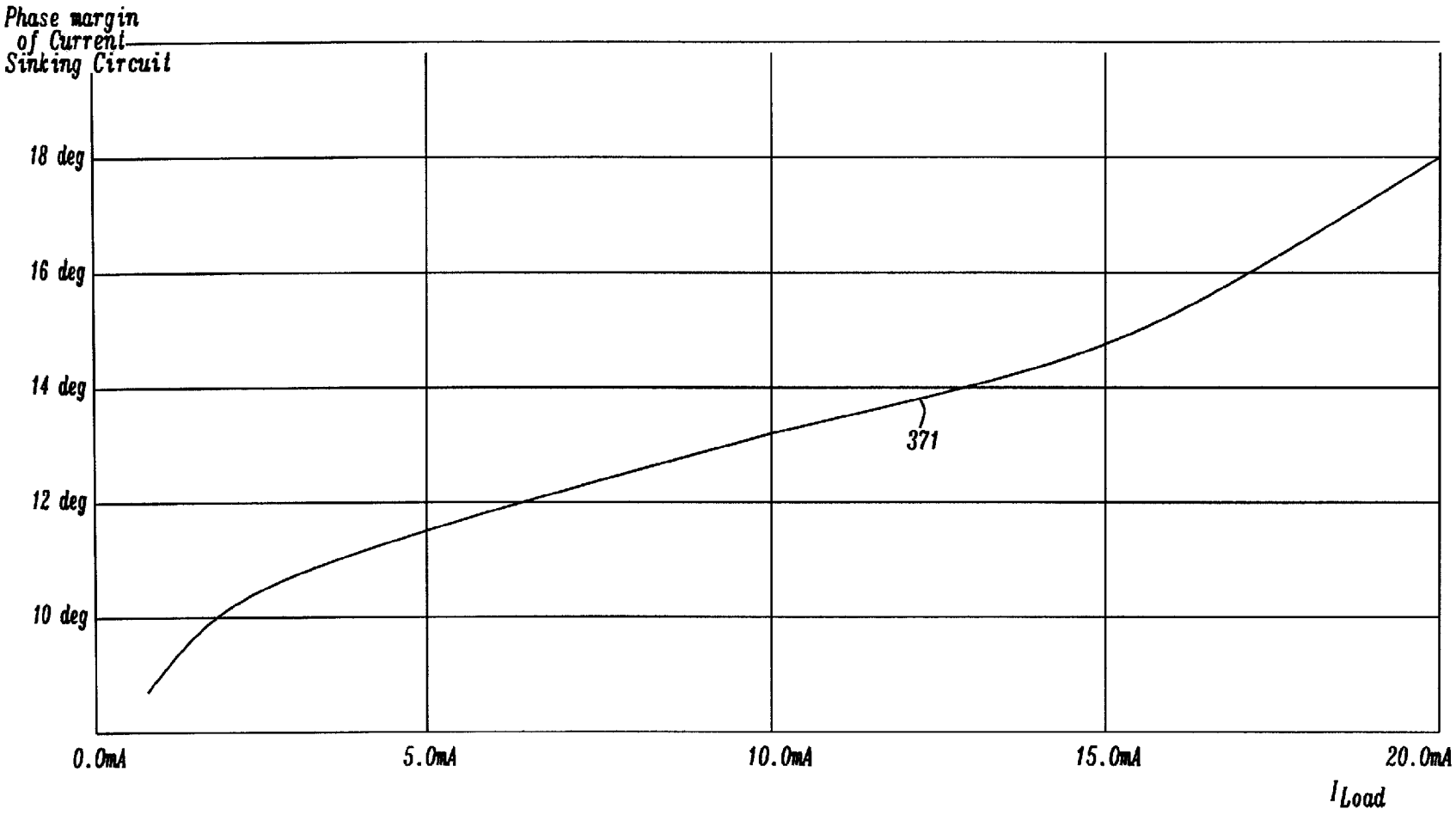

FIG. 3*e* shows the phase margin graph 371 (as a function of the load current) of the current sinking circuitry 311, 301 of FIG. 4 comprising an additional ESR resistor (3 Ohms). It can be seen that the phase margin 371 is positive for all load currents. Hence, the use of an additional external ESR resistor 402 which is arranged in series with the output capacitor 105 may be used to stabilize the current sinking circuitry 311, 301.

The use of an additional ESR resistor 402 typically has a detrimental effect on the DC and transient load regulation of multi-stage amplifier 200. Therefore it is desirable to provide circuitry which has similar effects as an additional external ESR resistor 402, but which does not exhibit the detrimental effects of an additional external ESR resistor 402.

Figure 5:
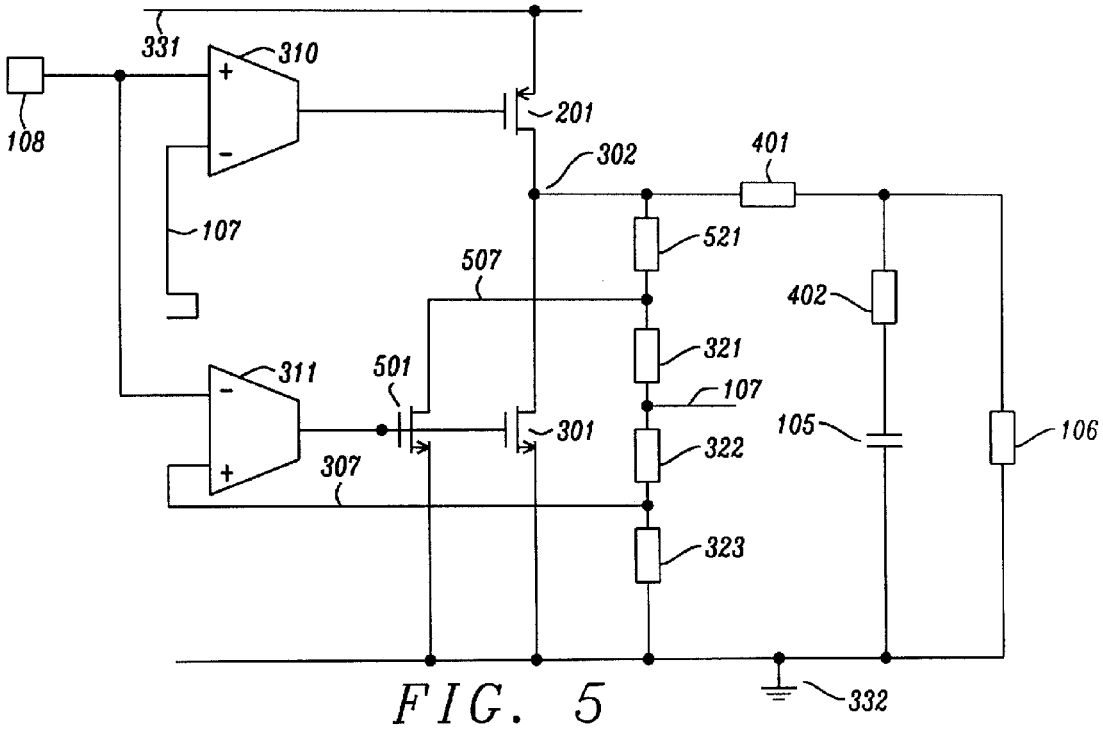
FIG. 5 shows a block diagram of an example multi-stage amplifier comprising a stabilized pull down circuit which comprises an internal ESR resistor.

FIG. 5 shows a circuit diagram where an internal ESR resistor 521 is used to stabilize the current sinking circuitry 311, 301. The external ESR resistor 402 may be completely removed or its resistance may be reduced. The internal ESR resistor 521 is arranged in series with the resistors 321, 322, 323 of the voltage divider 104. Typically the resistance of the ESR resistor 521 is substantially smaller than the resistance of the high resistor 321 of the voltage divider 104. The stabilization circuitry further comprises a bypass transistor 501 which is configured to sink a second current from the output node 302 of the multi-stage amplifier 200. A drain of the bypass transistor 501 is coupled to the internal ESR resistor 521. The voltage at the drain of the bypass transistor 501 is referred to as a sense voltage 507. The sense voltage 507 is typically proportional to the output voltage at the output node 302, and is derived using the internal ESR resistor 521.

Typically, the size of the bypass transistor 501 is substantially smaller than the size of the sink transistor 301. As a result of this, the second current which may be sunk via the bypass transistor 501 is typically substantially (e.g. by one or more orders of magnitude) smaller than a first current which is sunk via the sink transistor 301.

As can be seen in FIG. 5, the output stage of the current sinking circuitry 311, 301, 501 is divided into two parallel stages, a first stage which is formed by the sink transistor 301 which is directly coupled to the output node 302 of the multi-stage amplifier 200, and a second stage which is formed by the bypass transistor 501 which is coupled to the output node 302 of the multi-stage amplifier 200 via the internal ESR resistor 521. The signal output path via the bypass transistor 501 and the internal ESR resistor 521 is arranged in series with the output capacitor 105, thereby forming an LHP zero which stabilizes the current sinking circuit 311, 301, 501. The value of the internal ESR resistor 521 which is arranged in series with the output capacitor 105 may be determined by dividing the resistance RESR1 of the internal ESR resistor 521 by the size ratio of the sink transistor 301 and of the bypass transistor 501. By way of example, using an external ESR resistor 402 with an output capacitor 105, C1=470 nF, and an external ESR resistor 402, RESR=1 Ohm, an LHP zero=$(2*n*C1*RESR)^{-1}$=338 KHz may be obtained. The same LHP zero may be implemented by selecting an output capacitor 105, C1=470 nF, an internal ESR resistor 521, RESR1=10 Ohms, and a size ratio $N1/N_{1A}$=10, with N1 being the size of the sink transistor 301 and $N_{1A}$ being the size of bypass transistor 501.

Figure 7A:
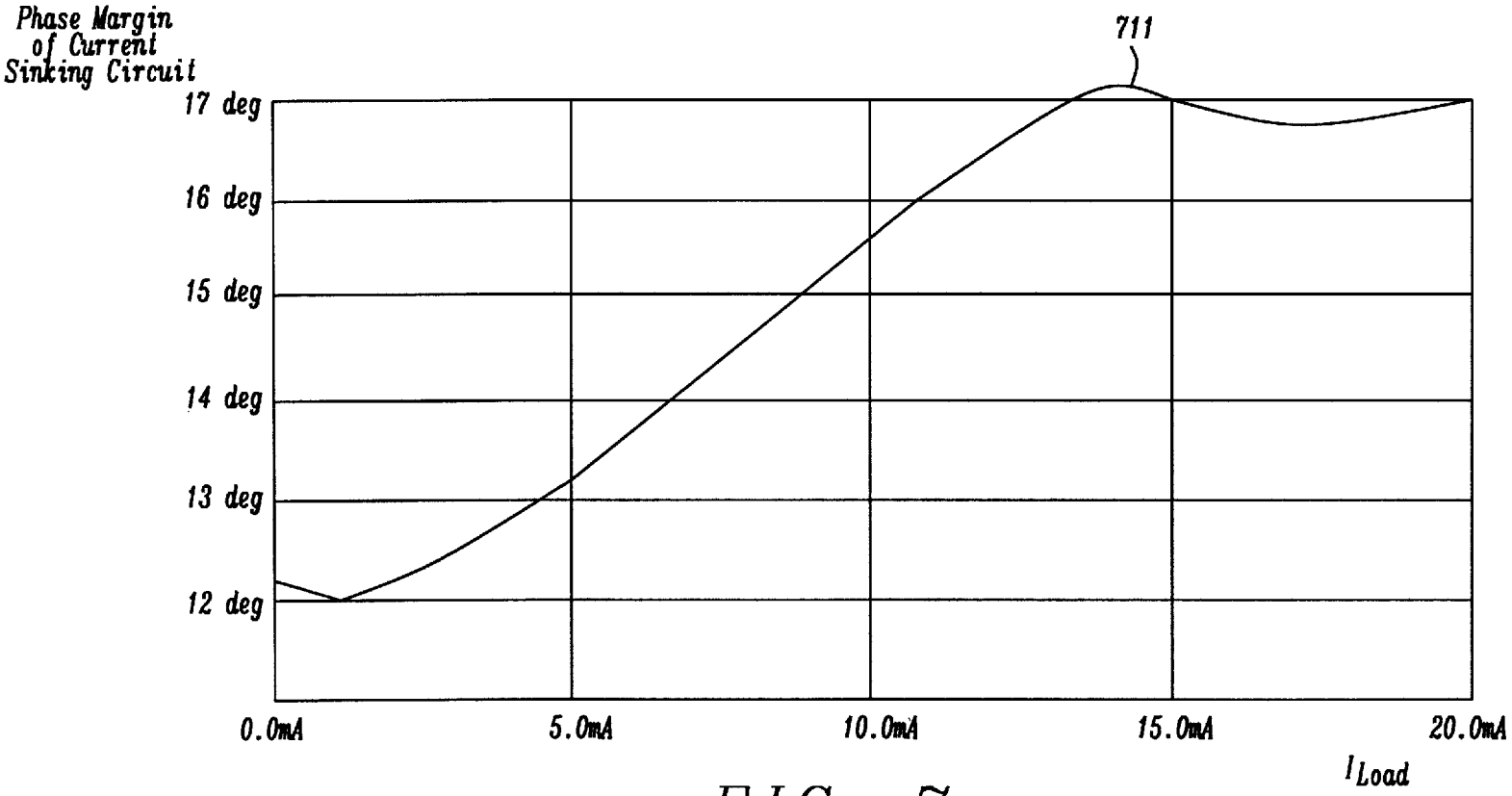
FIGS. 7*a* to 7*c* show example measurements.

As can be seen in FIG. 7*a*, a similar boost of the phase margin 711 can be achieved by using an internal ESR resistor 521 for compensation of the current sinking circuitry 311, 301, as when using an external ESR resistor 402 as seen in FIG. 3*e*. FIG. 7*a* shows the phase margin 711 for the current sinking circuitry 311, 301 as a function of load current sourced into the multi-stage amplifier 200. The phase margin 711 remains positive for all load currents.

Figure 7B:
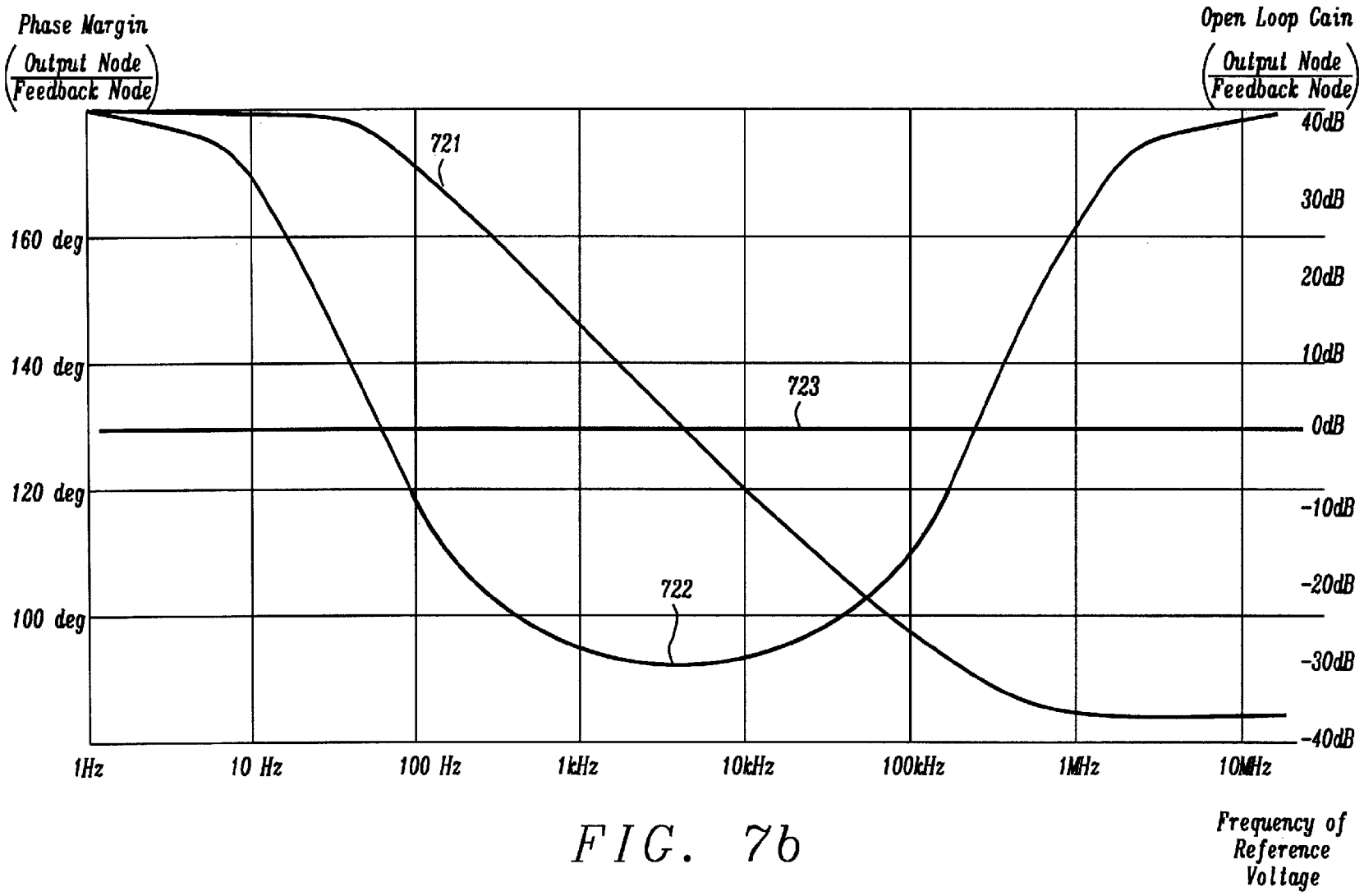

FIG. 7*b* shows the open loop gain 721 and the phase 722 of the circuit shown in FIG. 5 between the node of the feedback voltage 107 and the node of the output voltage of the multi-stage amplifier 200. The gain 721 and the phase 722 are depicted as a function of frequency of the reference voltage 108 (in order to analyze an AC response of the multi-stage amplifier 200). It can be seen that the gain 721 decays at 20 dB/decade at low frequency and decays at 0 dB/decade at high frequencies. This change in decay indicates the presence of a zero. A gain of zero is indicated by the reference numeral 723. The phase 722 does not fall below 90° for any of the illustrated frequencies (ranging from $10^0$ Hz up to $10^8$ Hz).

Figure 6:
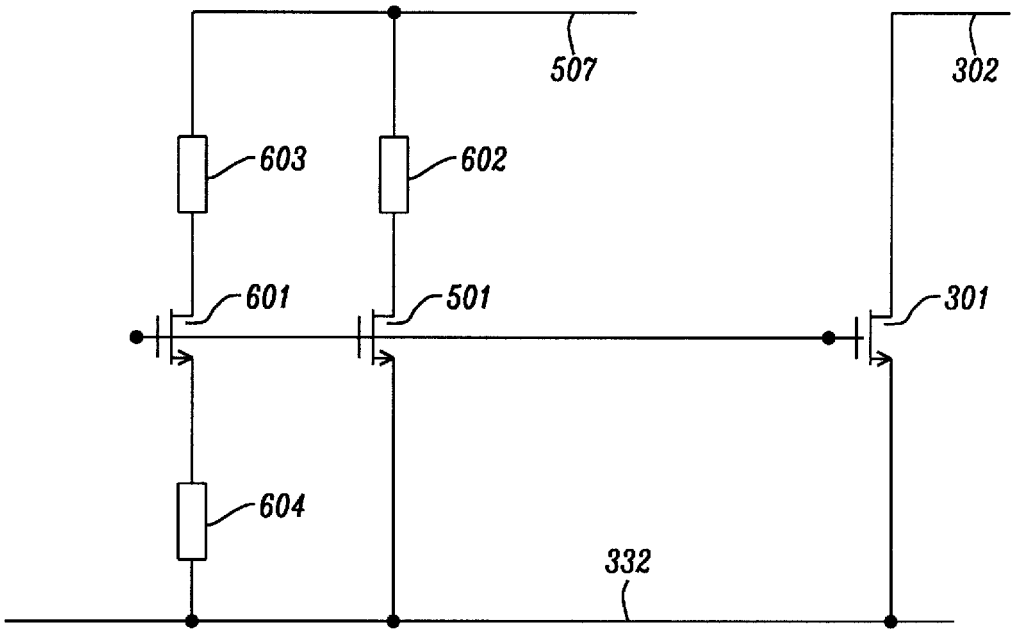
FIG. 6 shows a block diagram of components of an example pull down circuit.

As indicated above, the current flowing through the bypass transistor 501 is typically relatively small. A relatively high current through the bypass transistor 501 would change the regulating voltage within an overvoltage situation. The stabilizing circuitry may be modified to take on a substantially higher current at relatively low loads and smaller currents at relatively high loads. If more current is sunk via the bypass transistor 501 at lower loads, the effective value of the internal ESR resistor 521 increased, thereby increasing the stability of the current sinking circuitry 311, 301. Such a non-linear behavior regarding the amount of current which may be sunk via the bypass transistor 501 may be implemented using the circuitry shown in FIG. 6. The circuit of FIG. 6 comprises a plurality of different bypass transistors 501, 601 which are arranged in parallel and which are coupled to the output node 302 of the multi-stage amplifier 200 via the internal ESR resistor 521. Furthermore, differently sized current limiting resistors 602, 603, 604 may be used to modify the sink current through the different parallel branches. The additional bypass transistor 601 may be used to increase the sink current via the bypass transistors 501, 601 at relatively low load currents. As the current which is sunk by the additional bypass transistor 601 increases, the resistor 604 reduces the gate-source voltage $V_{GS}$ of the additional bypass transistor 601 and the resistor 603 reduces the drain-source voltage $V_{DS}$ of the additional bypass transistor 601, thereby forcing the additional bypass transistor 601 to being operated within its linear region and thereby limiting the sunk current. The resistor 602 has a similar function for the first bypass transistor 501. The number of bypass branches in parallel to the first bypass branch may be varied in accordance to the particular requirements.

Figure 7C:
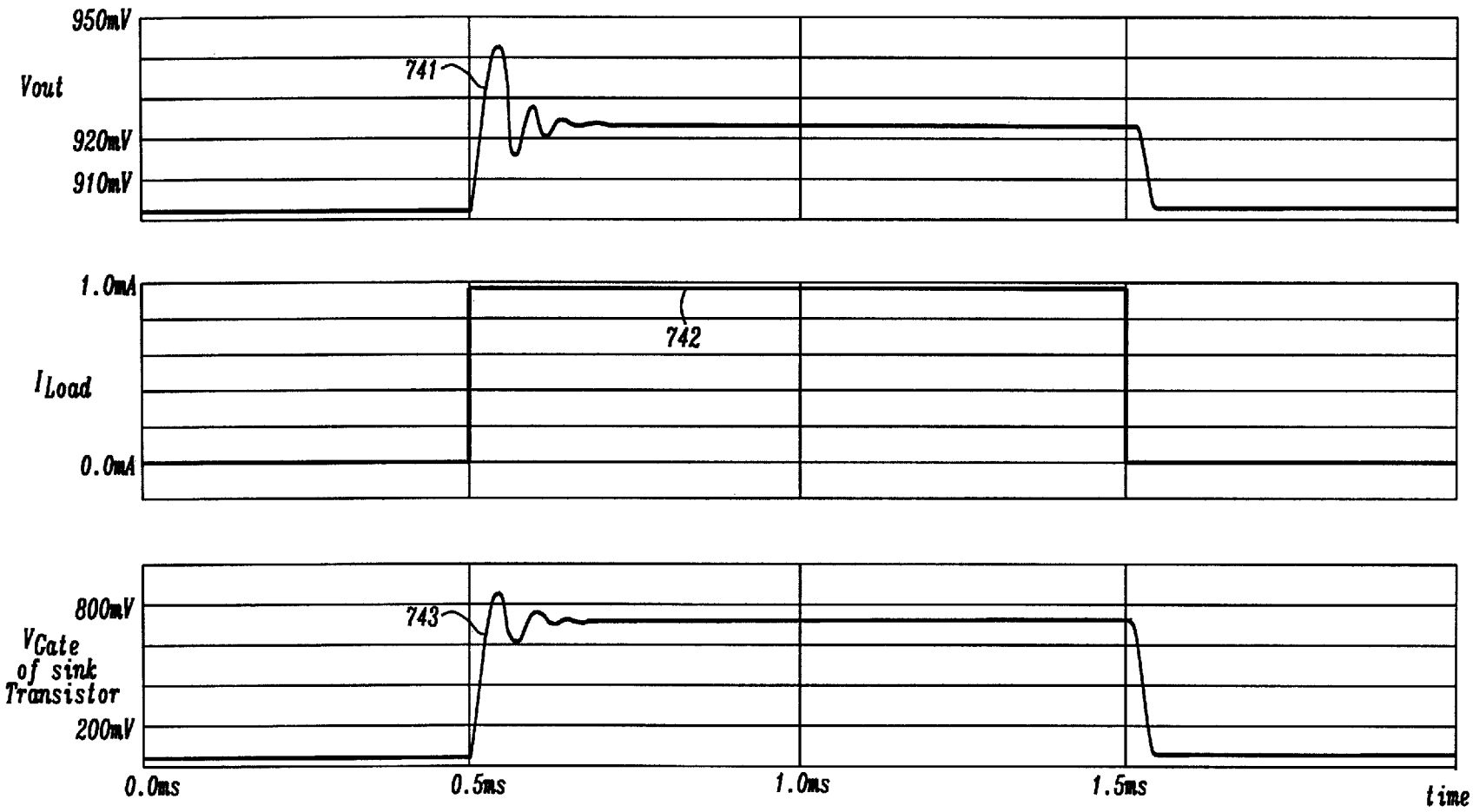

FIG. 7*c* shows the transient response of the current sinking circuitry comprising internal ESR compensation. In particular, the output voltage graph 741, the load current graph 742 and the gate voltage graph 743 at the gate of the sink transistor are illustrated as a function of time. The graphs of FIG. 7*c* may be compared to the graphs of FIGS. 3*b* and 3*c*. It can be seen that the oscillations of the output voltage 741 are reduced in amplitude and converge towards a stable output voltage 741.

Figure 8:
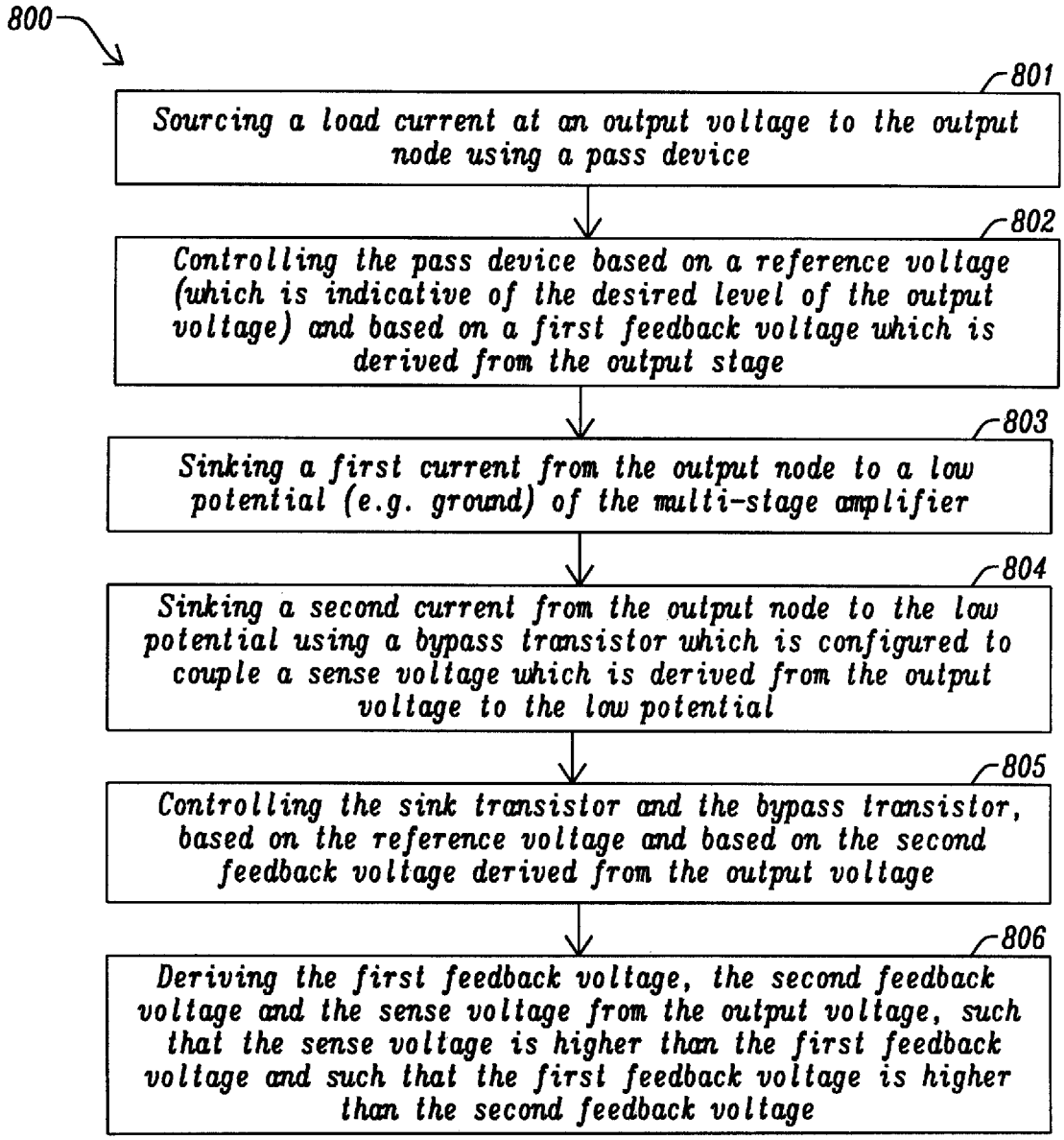
FIG. 8 shows a flow chart of an example method for handling voltage overshoots at the output node of a multi-stage amplifier.

FIG. 8 shows a flow chart of an example method 800 for reducing an overvoltage at an output node 302 of a multi-stage amplifier 200. The method 800 comprises sourcing 801 a load current at an output voltage to the output node 302 using a pass device 201. The load current is drawn from a high potential 331 (e.g. from a supply voltage) of the multi-stage amplifier 200. Furthermore, the method 800 comprises controlling 802 the pass device 201 based on a reference voltage 108 (which is indicative of the desired level of the output voltage) and based on a first feedback voltage 107 which is derived from the output voltage. In addition, the method 800 comprises sinking 803 a first current from the output node 302 to a low potential 332 (e.g. ground) of the multi-stage amplifier 200 using a sink transistor 301 which is arranged in series with the pass device 201. The output node 302 corresponds to a midpoint between the pass device 201 and the sink transistor 301.

The method 800 also comprises sinking 804 a second current from the output node 302 to the low potential 332 using a bypass transistor 501 which is configured to couple a sense voltage 507 which is derived from the output voltage to the low potential 332. In addition, the method 800 comprises controlling 805 the sink transistor 301 and the bypass transistor 501, based on the reference voltage 108 and based on a second feedback voltage 107 derived from the output voltage. Furthermore, the method 800 comprises deriving 806 the first feedback voltage 107, the second feedback voltage 307 and the sense voltage 507 from the output voltage, such that the sense voltage 507 is higher than the first feedback voltage 107 and such that the first feedback voltage 107 is higher than the second feedback voltage 307.

In the present document, current sinking circuitry has been described which may be used within a multi-stage amplifier, in order to reduce the output voltage of the multi-stage amplifier in case of an overvoltage situation. The reduction of the output voltage may be achieved in a rapid and stable and power efficient manner.

It should be noted that the description and drawings merely illustrate the principles of the proposed methods and systems. Those skilled in the art will be able to implement various arrangements that, although not explicitly described or shown herein, embody the principles of the invention and are included within its spirit and scope. Furthermore, all examples and embodiment outlined in the present document are principally intended expressly to be only for explanatory purposes to help the reader in understanding the principles of the proposed methods and systems. Furthermore, all statements herein providing principles, aspects, and embodiments of the invention, as well as specific examples thereof, are intended to encompass equivalents thereof.

What is claimed is:

1. A multi-stage amplifier comprising a pass device configured to source a load current at an output voltage to an output node; wherein the load current is drawn from a high potential of the multi-stage amplifier;

a first driver circuit configured to control the pass device based on a reference voltage and based on a first feedback voltage derived from the output voltage;

a sink transistor arranged in series with the pass device and configured to sink a first current from the output node to a low potential of the multi-stage amplifier; wherein the output node corresponds to a midpoint between the pass device and the sink transistor;

a bypass transistor configured to couple a sense voltage which is derived from the output voltage to the low potential, to sink a second current from the output node to the low potential;

a second driver circuit configured to control the sink transistor and the bypass transistor, based on the reference voltage and based on a second feedback voltage derived from the output voltage; and a voltage divider arranged between the output node and the low potential and configured to derive the first feedback voltage, the second feedback voltage and the sense voltage from the output voltage, such that the sense voltage is higher than the first feedback voltage and such that the first feedback voltage is higher than the second feedback voltage.

2. The multi-stage amplifier of claim 1, wherein the voltage divider comprises an internal ESR (Equivalent Serial Resistance) resistor configured to derive the sense voltage from the output voltage.

3. The multi-stage amplifier of claim 2, wherein the voltage divider comprises a high resistor which is coupled to the output node via the ESR resistor and which is configured to derive the first feedback voltage from the output voltage;

a dead band resistor which is coupled to the output node via the high resistor and which is configured to derive the second feedback voltage from the output voltage; and a low resistor which is coupled to the output node via the dead band resistor.

4. The multi-stage amplifier of claim 3, wherein a resistance of the high resistor is greater than a resistance of the internal ESR (Equivalent Serial Resistance) resistor by at least 1, 2, or 3 orders of magnitude.

5. The multi-stage amplifier of claim 1, wherein the first driver circuit is configured to generate a first gate voltage for a gate of the pass device based on the reference voltage and based on the first feedback voltage; and the second driver circuit is configured to generate a second gate voltage for a gate of the sink transistor and for a gate of the bypass transistor, based on the reference voltage and based on the second feedback voltage.

6. The multi-stage amplifier of claim 1, wherein a drain of the bypass transistor is coupled to the sense voltage; and a source of the bypass transistor is coupled to the low potential.

7. The multi-stage amplifier of claim 1, wherein a source of the pass device is coupled to the high potential;

a drain of the pass device is coupled to the output node;

a drain of the sink transistor is coupled to the output node; and a source of the sink transistor is coupled to the low potential.

8. The multi-stage amplifier of claim 1, wherein a size of the sink transistor is greater than a size of the bypass transistor by at least 1, 2, or 3 orders of magnitude.

9. The multi-stage amplifier (200) of claim 1, wherein a source of the bypass transistor (501) is coupled to the low potential (332) via a first current limiting resistor; and/or a drain of the bypass transistor (501) is coupled to the sense voltage (507) via a second current limiting resistor (602).

10. The multi-stage amplifier of claim 1, wherein the multi-stage amplifier further comprises a second bypass transistor arranged in parallel to the bypass transistor;

the second driver circuit is configured to also control the second bypass transistor; and a source of the second bypass transistor is coupled to the low potential via a third current limiting resistor and/or a drain of the second bypass transistor is coupled to the sense voltage via a fourth current limiting resistor.

11. The multi-stage amplifier of claim 1, further comprising an output capacitor arranged between the output node and the low potential.

12. The multi-stage amplifier of claim 1, wherein the second driver circuit comprises a differential amplifier configured to derive a gate voltage for application to a gate of the bypass transistor and to a gate of the sink transistor based on a difference of the reference voltage and the second feedback voltage.

13. The multi-stage amplifier of claim 1, wherein the first driver circuit comprises a differential amplification stage configured to derive an intermediate voltage based on a difference of the reference voltage and the first feedback voltage; and an intermediate amplification stage configured to derive a first gate voltage for controlling the pass device, based on the intermediate voltage.

14. The multi-stage amplifier of claim 1, wherein the pass device comprises a P-type metaloxide semiconductor, referred to as MOS, transistor;

the sink transistor comprises an N-type MOS transistor; and the bypass transistor comprises an N-type MOS transistor.

15. A method for reducing an overvoltage situation at an output node of a multi-stage amplifier, the method comprising, sourcing a load current at an output voltage to the output node using a pass device; wherein the load current is drawn from a high potential of the multi-stage amplifier;

controlling using a first driver circuit the pass device based on a reference voltage and based on a first feedback voltage derived from the output voltage;

sinking a first current from the output node to a low potential of the multi-stage amplifier using a sink transistor arranged in series with the pass device; wherein the output node corresponds to a midpoint between the pass device and the sink transistor;

sinking a second current from the output node to the low potential using a bypass transistor configured to couple a sense voltage which is derived from the output voltage to the low potential;

controlling using a second driver circuit the sink transistor and the bypass transistor, based on the reference voltage and based on a second feedback voltage derived from the output voltage; and deriving a voltage divider the first feedback voltage, the second feedback voltage and the sense voltage from the output voltage, such that the sense voltage is higher than the first feedback voltage and such that the first feedback voltage is higher than the second feedback voltage.

16. The method for reducing an overvoltage situation at an output node of a multi-stage amplifier of claim 15, wherein the voltage divider comprises an internal ESR (Equivalent Serial Resistance) resistor to derive the sense voltage from the output voltage.

17. The method for reducing an overvoltage situation at an output node of a multi-stage amplifier of claim 16, wherein the voltage divider comprises a high resistor which is coupled to the output node via the ESR resistor and which derives the first feedback voltage from the output voltage;

a dead band resistor which is coupled to the output node via the high resistor and which derives the second feedback voltage from the output voltage; and a low resistor which is coupled to the output node via the dead band resistor.

18. The method for reducing an overvoltage situation at an output node of a multi-stage amplifier of claim 17, wherein a resistance of the high resistor is greater than a resistance of the internal ESR (Equivalent Serial Resistance) resistor by at least 1, 2, or 3 orders of magnitude.

19. The method for reducing an overvoltage situation at an output node of a multi-stage amplifier of claim 15, wherein the first driver circuit generates a first gate voltage for a gate of the pass device based on the reference voltage and based on the first feedback voltage; and the second driver circuit generates a second gate voltage for a gate of the sink transistor and for a gate of the bypass transistor, based on the reference voltage and based on the second feedback voltage.

20. The method for reducing an overvoltage situation at an output node of a multi-stage amplifier of claim 15, wherein a drain of the bypass transistor is coupled to the sense voltage; and a source of the bypass transistor is coupled to the low potential.

21. The method for reducing an overvoltage situation at an output node of a multi-stage amplifier of claim 15, wherein a source of the pass device is coupled to the high potential;

a drain of the pass device is coupled to the output node;

a drain of the sink transistor is coupled to the output node; and a source of the sink transistor is coupled to the low potential.

22. The method for reducing an overvoltage situation at an output node of a multi-stage amplifier of claim 15, wherein a size of the sink transistor is greater than a size of the bypass transistor by at least 1, 2, or 3 orders of magnitude.

23. The method for reducing an overvoltage situation at an output node of a multi-stage amplifier of claim 15, wherein a source of the bypass transistor is coupled to the low potential via a first current limiting resistor; and/or a drain of the bypass transistor is coupled to the sense voltage via a second current limiting resistor.

24. The method for reducing an overvoltage situation at an output node of a multi-stage amplifier of claim 15, wherein the multi-stage amplifier further comprises a second bypass transistor arranged in parallel to the bypass transistor;

the second driver circuit is configured to also control the second bypass transistor; and a source of the second bypass transistor is coupled to the low potential via a third current limiting resistor and/or a drain of the second bypass transistor is coupled to the sense voltage via a fourth current limiting resistor.

25. The method for reducing an overvoltage situation at an output node of a multi-stage amplifier of claim 15, further comprising an output capacitor arranged between the output node and the low potential.

26. The method for reducing an overvoltage situation at an output node of a multi-stage amplifier of claim 15, wherein the second driver circuit comprises a differential amplifier to derive a gate voltage for application to a gate of the bypass transistor and to a gate of the sink transistor based on a difference of the reference voltage and the second feedback voltage.

27. The method for reducing an overvoltage situation at an output node of a multi-stage amplifier of claim 15, wherein the first driver circuit comprises a differential amplification stage to derive an intermediate voltage based on a difference of the reference voltage and the first feedback voltage; and an intermediate amplification stage to derive a first gate voltage for controlling the pass device, based on the intermediate voltage.

28. The method for reducing an overvoltage situation at an output node of a multi-stage amplifier of claim 15, wherein the pass device comprises a P-type metal oxide semiconductor, referred to as MOS, transistor;

the sink transistor comprises an N-type MOS transistor; and the bypass transistor comprises an N-type MOS transistor.

* * * * *